US005261463A

United States Patent [19]

Sato

[11] Patent Number: 5,261,463

[45] Date of Patent: Nov. 16, 1993

[54] COMPUTER APPARATUS FOR CHECKING THE CORRECTNESS OF A LOOM ADJUSTMENT

[75] Inventor: Yutaka Sato, Kariya, Japan

[73] Assignee: Kabushiki Kaisha Toyoda Jidoshokki Seisakusho, Kariya, Japan

[21] Appl. No.: 834,332

[22] PCT Filed: Jun. 12, 1991

[86] PCT No.: PCT/JP91/00790

§ 371 Date: Mar. 12, 1992

§ 102(e) Date: Mar. 12, 1992

[87] PCT Pub. No.: WO91/19843

PCT Pub. Date: Dec. 26, 1991

[30] Foreign Application Priority Data

Jun. 13, 1990 [JP] Japan ..... 2-154631

[51] Int. Cl.[5] ..... D03D 49/22

[52] U.S. Cl. ..... 139/1 R; 139/435.2; 139/114; 364/470; 364/921.1; 364/189

[58] Field of Search ..... 139/1 R, 435.2, 35, 139/114, 115; 364/470, 921.1, 189, 188

[56] References Cited

U.S. PATENT DOCUMENTS

| | | | |
|---|---|---|---|
| 4,819,310 | 4/1989 | Beerli et al. | 364/470 X |
| 4,835,699 | 5/1989 | Mallard | 139/35 |
| 4,893,250 | 1/1990 | Sainen | 139/1 R |
| 4,953,596 | 9/1990 | Takegawa | 139/435.2 X |
| 5,014,756 | 5/1991 | Vogel et al. | 139/114 |

FOREIGN PATENT DOCUMENTS

| | | | |
|---|---|---|---|
| 57-71452 | 5/1982 | Japan | 139/1 R |
| 59-82450 | 5/1984 | Japan | 139/1 R |
| 62-133151 | 6/1987 | Japan | 139/1 R |
| 63-21951 | 1/1988 | Japan | 139/1 R |

*Primary Examiner*—Andrew M. Falik
*Attorney, Agent, or Firm*—Brooks Haidt Haffner & Delahunty

[57] ABSTRACT

In a loom, a back roller for guiding warps is supported by a pair of back roller brackets which are mounted on and are horizontally adjustable relative to second back brackets. The latter brackets are mounted on and are vertically adjustable relative to fixed back brackets. The vertical positions of the second back brackets relative to the fixed back brackets are detected by light projectors and receivers. A computer compares the detected positions obtained from the light receivers with a preset position stored in a memory and extinguishes indicator lamps when the detected position agrees with the preset one. In similar manner the horizontal positions of the back roller brackets relative to the second back brackets are detected by associated light projectors and receivers, compared with preset positions stored in the computer memory, and indicator lamps are extinguished when the detected horizontal position agrees with the preset one.

13 Claims, 3 Drawing Sheets

COMPUTER APPARATUS FOR CHECKING THE CORRECTNESS OF A LOOM ADJUSTMENT

TECHNICAL FIELD

The present invention relates to an apparatus for checking the status of a loom for weaving. More particularly, the apparatus checks and confirms whether the mechanical settings relating to warp threads are properly adjusted to meet required mechanical settings when different kinds of fabric are to be woven.

BACKGROUND ART

The quality of a fabric is achieved by making proper mechanical adjustments that effect the warp threads. Such adjustments are set by re-positioning of the vertical and horizontal positions of back rollers which guide the warp threads fed out from a warp beam, re-sizing of a shed formed by the warp threads and adjusting the timing of the closing of the shed.

The proper mechanical settings of looms vary fabric to fabric. Therefore, it is necessary to adjust the various mechanical parts of a loom before weaving a different kind of fabric. The adjustments include setting of the vertical and horizontal positions of the back rollers, sizing of the shed formed by the warp threads and timing of the closing of the shed.

According to the prior art, the adjustments of the loom are determined by the intuition of the operator who relies on the instruction manual and his or her experience. Since the standard of the adjustment varies from operator to operator, the quality of the woven fabric can not be kept uniform. Where the factory is equipped with a number of looms, much labor and time is required to discover the identity of the poorly adjusted loom. Hence, it is difficult to manage a number of looms to produce the consistent quality of the fabric.

Japanese Unexamined Patent Publication No. 63-21951 discloses and apparatus having a storage means which stores in a computer memory, the various requirements of the weaving conditions according to each of the different kinds of fabric. The requirements include such data as; kinds of the threads, width of fabric to be woven, weaving density of the thread counts and weaving composition. The apparatus also has a display means that displays the stored data corresponding to the fabric to be woven whenever the need arises. This display means displays the required data of the fabric to be woven only if the data have been stored in the computer memories.

The operator makes mechanical adjustments of various parts in the loom to coincide with the displayed weaving requirements, which are previously stored in the computer memory.

Consequently, a more standard fabric quality is obtained than would be possible with looms adjusted in accordance with the operator's intuition.

In the method of adjusting the various parts of the loom while watching the display means, however, it is impossible to remove every error in mechanical adjustments. If any error occurs during adjustments, then much labor and time is still needed to discover the error.

DISCLOSURE OF THE INVENTION

An object of the present invention is intended to provide an apparatus which has a judging means for comparing and judging the performed mechanical adjustments relating to warp threads in the loom with the prestored requirements of the fabric to be woven, and also has a display means which displays the result of each comparison whether the mechanical adjustment and the weaving requirement coincide. Therefore, the possibility that the mechanical adjustment involves errors in entirely eliminated.

In accordance with the present invention there is provided an apparatus for use in adjusting the setting of the warp handling mechanism of a loom, the apparatus comprising storage means for storing data representing the desired settings of said mechanism for various types of fabrics; detecting means operatively coupled with said mechanism for detecting actual loom settings; judging means operatively connected to said storage means and said detecting means for comparing the desired mechanism settings and the actual settings and judging whether the desired and actual settings coincide with each other; and display means disposed in proximity to said mechanism for indicating when said mechanism is adjusted to said desired settings.

BRIEF DESCRIPTION OF DRAWINGS

The invention will be better understood after reading the following detailed description with reference to the appended drawings in which.

BEST MODE FOR CARRYING OUT THE INVENTION

Figure 1:
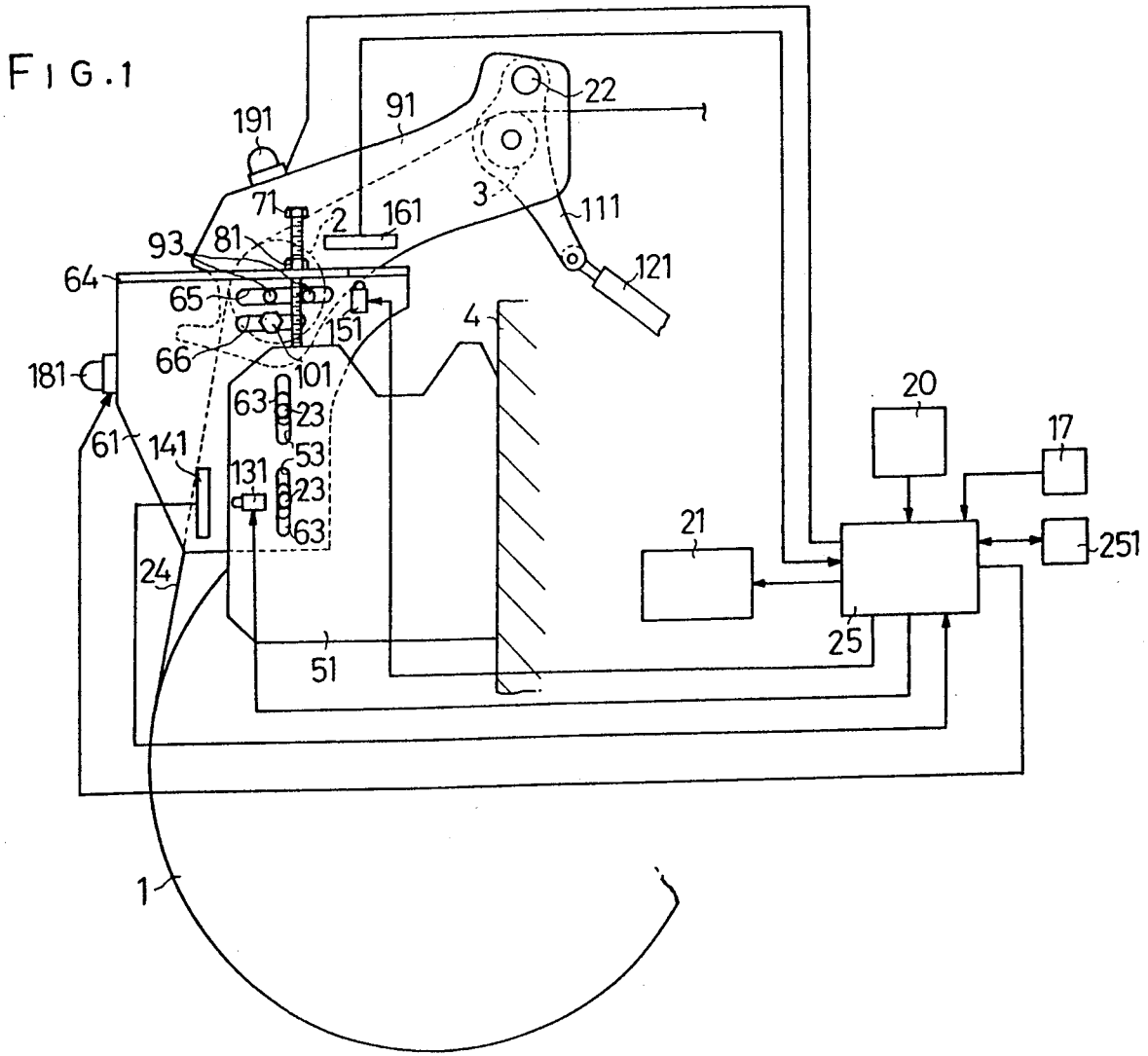
FIG. 1 is a side view of the essential portions in accordance with the present invention.
Figure 2:
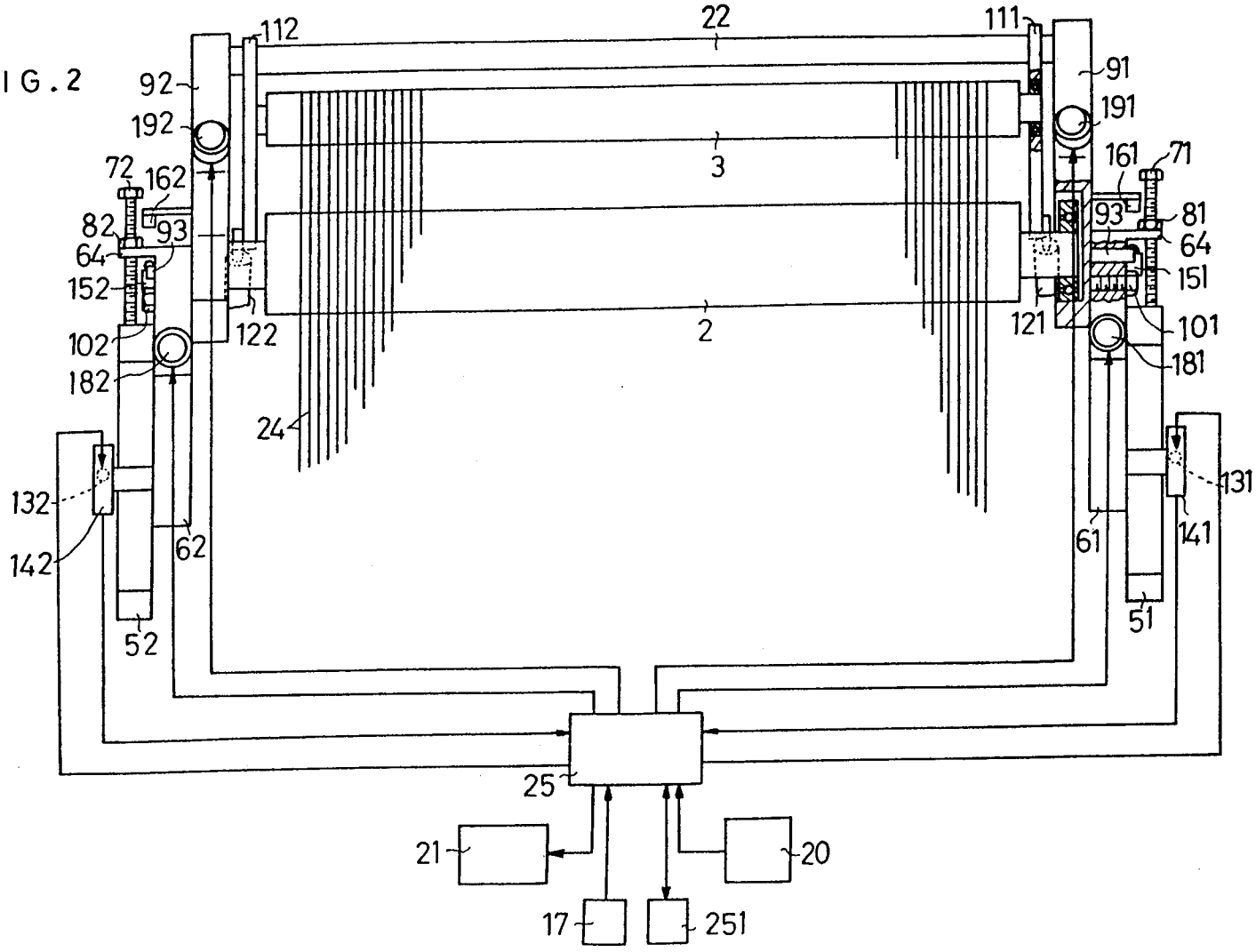
FIG. 2 shows a back view of the essential portions of the present invention.

An example of the invention is hereinafter described by referring to FIGS. 1–3.

A warp beam 1 furnishes a warp thread 24 which is guided by a back roller 2 and an easing roller 3. The base of the loom has frames 4 at both sides, and back brackets 51 and 52 are mounted on these frames 4, respectively. Second back brackets 61 and 62 are held to the back brackets 51 and 52, respectively, in such a way that the vertical positions of the second back brackets can be adjusted relative to the brackets 51 and 52. A pair of guide holes slots 53 are formed in the sides of the back brackets 51 and 52. A pair of guided elements 63 are located on the sides of the second back brackets 61 and 62. Since the guided elements 63 are guided along their respective guide holes 53, the second back brackets 61 and 62 can slide up and down relative to the back brackets 61 and 62. These brackets are tightened with bolts 23. The second back brackets 51 and 52 have flanges 64 at their tops. Adjusting bolts 71 and 72 are bolted to the flanges 64 and tightened with nuts 81 and 82, respectively. The leading ends of the adjusting bolts 71 and 72 bear against the upper ends of the back brackets 51 and 52, respectively. Therefore, the vertical positions at which the second back brackets 61 and 62 are mounted can be adjusted relative to the back brackets 51 and 52 by threadedly adjusting the extensions of the adjusting bolts 71 and 72 in the second back brackets 61 and 62.

Other back roller brackets 91 and 92 are mounted on the second back brackets 61 and 62, respectively, in such a way that the positions of these brackets 91, 92 can be moved horizontally forward and backward. Guide pins 93, 93 are disposed in the sides of the back roller brackets 91 and 92. Guide holes slots 65, 66 are formed in the sides of the second back brackets 61 and 62.

Tightening bolts, 101, 102 are passed through the guide holes 66, and then screwed into the back roller brackets 91 and 92 and securely tightened to lock the brackets 91 and 92 against movement relative to second back brackets 61 and 62.

A back roller 2 is mounted between the back roller brackets 91 and 92. Easing brackets 111 and 112 are pivottally supported by the back roller brackets 91 and 92, respectively. An easing roller 3 is mounted between the easing brackets 111 and 112. The easing brackets 111 and 112 are operatively connected with a crank mechanism (not shown) via connecting rods 121 and 122. The crank mechanism operates in synchronism with the driving motor of the loom. Thus, the easing roller 3 is swung about an easing pin 22 by the crank mechanism in synchronism with the shedding of the warp threads.

A light emitter 131 is disposed opposite a light receiver 141 between the back bracket 51 and the second back bracket 61. Similarly, another light emitter 132 is disposed opposite to a light receiver 142 between the back bracket 52 and the second back bracket 62. The light receivers 141 and 142 each consist of a linear CCD sensor (i.e., a charge coupled device). Likewise, a light emitter 151 is located opposite a light receiver 161 consisting of a linear CCD sensor between the second back bracket 61 and the back roller bracket 91. A light emitter 152 is positioned opposite a light receiver 162 consisting of a linear CCD sensor between the second back bracket 62 and the back roller bracket 92. The linear type CCDs provide for precise detection of the relative positions of the parts.

The light emitters 131, 132, 151, 152 and the light receivers 141, 142, 161, 162 are connected with a computer 25. When a switching device 17 for turning the sensors on and off, is so operated that it is closed, the computer 25 activates the light emitters 131, 132, 151, 152 and the light receivers 141, 142, 161, 162. Indicator lamps 181 and 182 are mounted on the second back brackets 61 and 62, respectively. Also indicator lamps 191 and 192 are mounted on the back roller brackets 91 and 92, respectively. These lamps are illuminated under the instructions of the computer 25.

An input device 20 is connected with the computer 25. Data X about the relations of the vertical positions of the second back brackets 61 and 62 to the back brackets 51 and 52 and data Y about the relations of the horizontal positions of the back roller brackets 91 and 92 to the second back brackets 61 and 62 are entered into a memory or storage means 251 for the computer 25 through the input device 20. Data X and Y are empirically predetermined in accordance with the kind of fabric to be woven. The data X and Y about the positions are displayed on a display unit 21 upon setting computer 25 for the fabric to be woven so as to enable the operators to visibly confirm the vertical position x and horizontal position y of the back roller 2 and easing roller 3. Therefore, the back roller 2 and the easing roller 3 can be placed in the proper positions for the kind of fabric to be woven.

Figure 3:
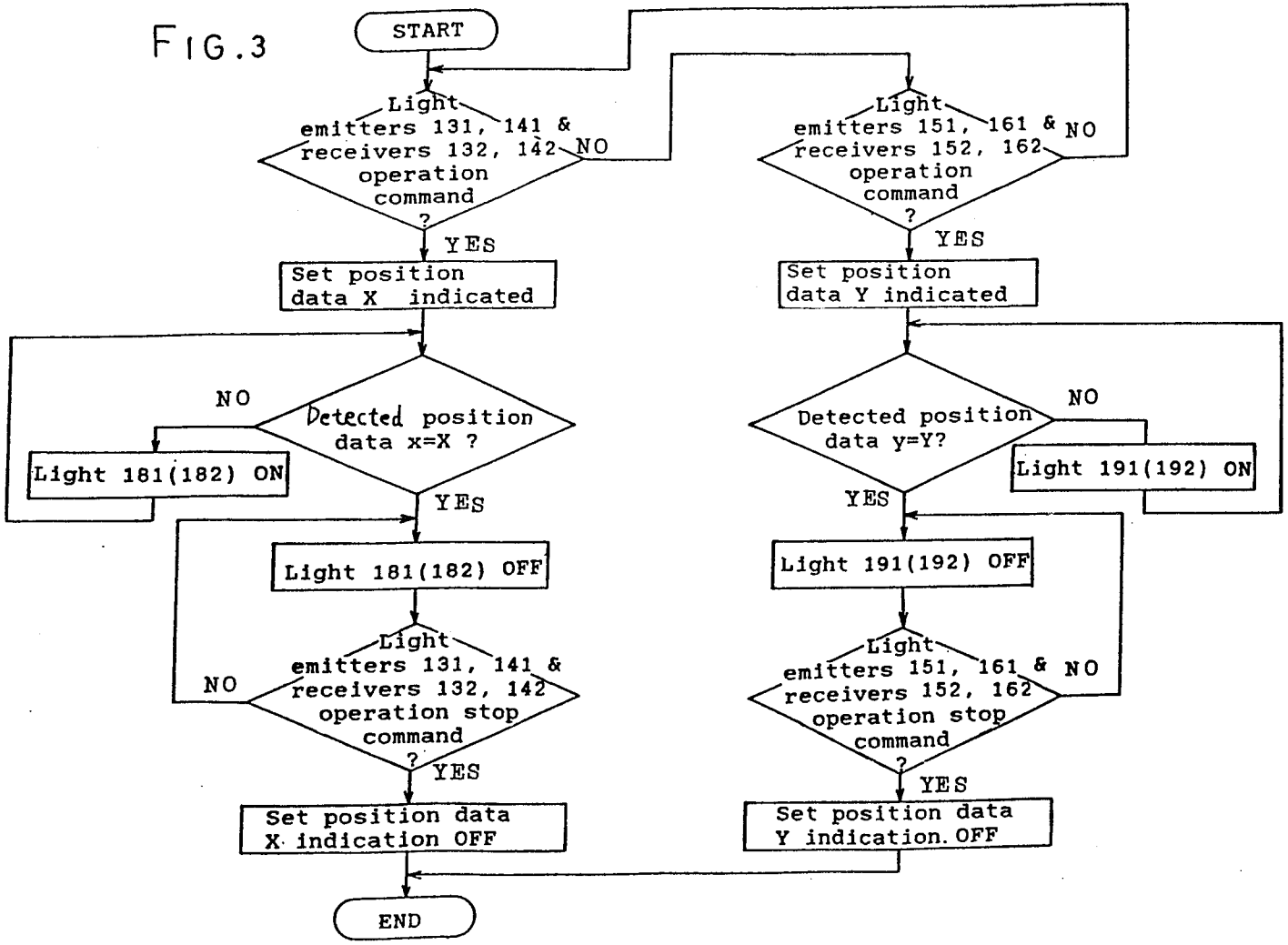
FIG. 3 is a flow chart showing the program used for adjusting and setting conditions of the loom for weaving.

FIG. 3 illustrates the program used to set the weaving conditions by setting or adjusting the indication of data X and Y specifying the settings for handling the warp threads when the parameters of the machine are to be modified.

The switching device 17 is turned on to activate the light emitters 131 and 141. The computer 25 activates the emitters 131 and 141, and reads the data X about the required positions from the memory 251, and displays the data on the display unit 21. The light emitter 131 emits light to the light receiver 141, which then delivers information about the illuminated position to the computer 25. The computer 25 calculates the vertical position x of the second back bracket 61 relative to the back bracket 51 from the information about the illuminated position, and compares the data X for desired position with the data x of the detected position, the data X being stored in the memory 251. If $x \neq X$, then the computer 25 instructs the indicator lamp 181 to light up, so that this lamp goes on. When the relation $x = X$ is attained by operator adjustment of the vertical position of the second back bracket 61, the computer 25 instructs the indicator lamp 181 to go out, whereby this lamp is extinguished. This permits the operator to confirm that the adjustment of the vertical position of the second back bracket 61 relative to the back bracket 51 has been made as intended. Then the operator operates the switching device 17 so as to open it, thus stopping the operation of the light emitters 131 and 141. Subsequently, adjustment of the vertical position of the other second back bracket, 62, is initiated. The switching device 17 for turning on or off the sensors is operated so as to open it. As a result, the desired position data X presented on the display unit 21 is erased.

The adjustment for the vertical position of the second back bracket 62 is similarly made in response to the operation of the light emitters 132 and 142.

When the adjustments for the vertical positions of the second back brackets 61 and 62 have been completed, the horizontal positions of the back roller brackets 91 and 92 relative to the second back brackets 61 and 62 are adjusted. The switching device 17 for turning on or off the sensors is operated so as to close it. Then, the computer 25 activates the light emitters 151 and 161. At the same time, data Y about the desired position is displayed on the display unit 21, the data Y being previously stored in the memory 251. The light emitter 151 projects light to the light receiver 161, which sends information about the illuminated position to the computer 25. The computer 25 calculates the horizontal position y of the back roller bracket 91 relative to the second back bracket 61 from the information about the illuminated position, and compares the data about the desired position with the data y about the detected position. If $y \neq Y$, then the computer 25 orders the indicator lamp 191 to light up, so that the lamp 191 goes on. If the relationship $y = Y$ is accomplished by the adjustment of the horizontal position of the back roller bracket 91, then the computer 25 instructs the indicator lamp 191 to go out. As a result, the indicator lamp 191 is put out. This enables the operator to check that the adjustment of the horizontal position of the back roller bracket 91 relative to the second back bracket 61 has been made as instructed. Subsequently, adjustment of the horizontal position of the other back roller bracket 92 is started. This adjustment is made similarly in response to the operation of the light emitters 152 and 162.

In this manner, the vertical positions of the second back brackets 61, 62 and the horizontal positions of the back rollers brackets 91, 92 are adjusted and set by comparing the actual detected positional data x and y derived from the detecting devices of the light emitters 131, 132, 151, and 152 and the light receivers 141, 142, 161, 162 with the preselected positional data X and Y. These operations are accomplished by lighting or extinguishing the indicator lamps 181, 182, 191 and 192.

Consequently, it is not necessary to rely on a skilled worker's experience or intuition in adjusting or setting the weaving conditions. Hence, the adjustment and setting are performed without producing error. In addition, the quality of the fabric is stabilized. It is also possible to appropriately modify the data X and Y for the preset positions according to the actual experience in weaving techniques and to store the modified data in the memory 251. The stored data X and Y for the desired positions are weighed for selection. If the parameters of the machine are subsequently modified, the data about the desired positions can be selected according to the weighting. The data X and Y for the desired positions can assume numerous values which are required to be stored according to the different kinds of fabric to be woven. For this purpose, the above-described weighting is necessitated.

When the data X and Y for the desired positions are coincident with the data x and y obtained by detecting the positions, the indicator lamps 181, 182, 191, 192 may be operated so as to change from extinguished to illuminated rather than the reverse.

It is to be noted that the present invention is not limited to the above example. For example, the light emitters and receivers of the above example can be replaced by detecting means which measure distances, using reflection type photoelectric sensors.

It is possible to apply the present invention as a confirming device for setting and adjusting the parts of the loom handling the warp threads, that is, the mechanically adjustable parameters. These include the vertical and horizontal positions of the back rollers, the timing of the shed formation by the warp threads, the timing of the shed closure, the timing of the shed formation by the selvedge threads, the timing of the easing roller and the control of the amount of easing.

I claim:

1. An apparatus for use in adjusting the setting of adjustable warp handling mechanism of a loom, the apparatus comprising:

storage means for storing data representing desired settings of said mechanism for various types of fabrics;

detecting means for coupling to said mechanism for continually detecting actual loom settings while said mechanism is being adjusted;

judging means operatively connected to said storage means and said detecting means for continually comparing desired mechanism settings and actual settings and continually judging whether the desired and actual settings coincide with each other; and display means for disposition in proximity to said mechanism for indicating when said mechanism is adjusted to said desired settings.

2. An apparatus as set forth in claim 1, wherein said judging means includes a central processing unit connected to said storage means, said central processing unit being connected to an input device for inputting data corresponding to the desired mechanism settings into said storage means.

3. An apparatus as set forth in claim 2, wherein said storage means is constructed to store data indicative of the desired mechanism settings in accordance with the kink of fabric to be woven.

4. An apparatus for use in adjusting the setting of the warp handling mechanism of a loom having a plurality of back rollers that guide warp threads fed from a warp beam, said back rollers each being carried by a first roller bracket which is supported for horizontally adjustable movement by a respective second bracket, and each second bracket is supported for vertically adjustable movement by a third bracket, said apparatus comprising:

storage means for storing data representing the desired loom settings for various types of fabrics, the desired loom settings including a desired horizontal position and a desired vertical position of said back rollers;

detecting means for detecting actual loom settings, said detecting means including a plurality of light emitters and a plurality of light receivers for mounting on oppositing ones of said brackets to detect the relative movement of the brackets;

a central processing unit connected to said storage means and said detecting means for comparing desired loom settings and actual loom settings and judging whether desired and actual loom settings coincide with each other;

display means connected to said central processing unit for displaying the result of said judging; and an input device connected to said central processing unit for inputting desired loom settings into the storage means.

5. An apparatus as set forth in claim 4, wherein said display means includes display lights for mounting on at least one of said second brackets and said first roller brackets.

6. An apparatus for adjusting the setting of the warp handling mechanism of a loom, the apparatus comprising:

storage means for storing data representing desired settings of said mechanism for various types of fabrics, said mechanism settings including the vertical and horizontal positions of at least one back roller than guides warp threads fed from a warp beam, said back roller being carried by a first roller bracket which is supported for horizontal movement by a second bracket which, in turn, is supported for vertical movement by a fixed third bracket;

detecting means operatively coupled with said mechanism for detecting actual loom settings;

judging means operatively connected to said storage means and said detecting means for comparing desired mechanism settings and actual settings and judging whether the desired and actual settings coincide with each other; and display means disposed in proximity to said mechanism for indicating when said mechanism is adjusted to said desired settings.

7. An apparatus as set forth in claim 6, wherein said detecting means comprises means for detecting the vertical position of said second bracket relative to said fixed third bracket, and means for detecting the horizontal position of said first roller bracket relative to said second bracket.

8. An apparatus as set forth in claim 7, wherein said detecting means includes a first light emitter and a first light receiver adapted to be mounted on opposing ones of said fixed third bracket and said second bracket.

9. An apparatus as set forth in claim 8, wherein said detecting means includes a second light emitter and a second light receiver adapted to be mounted on opposing ones of said second bracket and said first bracket.

10. An apparatus as set forth in claim 9, wherein each light receiver is a linear type charge coupled device.

11. An apparatus as set forth in claim 7, wherein said display means includes display lights adapted to be mounted on at least one of said second bracket and said first roller bracket.

12. An apparatus as set forth in claim 11 including a computer for turning off said display lights when the actual mechanism settings match the desired settings.

13. An apparatus as set forth in claim 7, wherein said detecting means includes a light emitter and a light receiver mounted each on opposing ones of said second bracket and said first bracket.

* * * * *

UNITED STATES PATENT AND TRADEMARK OFFICE

CERTIFICATE OF CORRECTION

PATENT NO. : 5,261,463

DATED : November 16, 1993

INVENTOR(S) : Y. Sato

It is certified that error appears in the above-indentified patent and that said Letters Patent is hereby corrected as shown below:

Column 1, line 39, "and" should read --an--.

Column 2, line 54, after "61 and 62" should read --51 and 52--;

Column 3, line 3, "slots" should read --(slots)--; line 13, correct spelling --pivotally--.

Column 4, line 13, before "desired" insert --the--;

Column 5, line 2, delete "and" (first occurrence); line 15, "weighed" should read --weighted--.

Column 6, line 2, "kink" should read --kind--; line 20, "oppositing" should read --opposing--; line 43, "than" should read --that--.

UNITED STATES PATENT AND TRADEMARK OFFICE

CERTIFICATE OF CORRECTION

PATENT NO. : 5,261,463

DATED : November 16, 1993

INVENTOR(S) : Y. Sato

It is certified that error appears in the above-indentified patent and that said Letters Patent is hereby corrected as shown below:

Column 7, line 5, after "first" insert --roller--; line 7, before "light" insert --said--.

Signed and Sealed this

Fifth Day of July, 1994

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,261,463

DATED : November 16, 1993

INVENTOR(S) : Y. Sato

It is certified that error appears in the above-indentified patent and that said Letters Patent is hereby corrected as shown below:

Column 2, line 55, "51 and 52" should read --61and 62 --.

Signed and Sealed this

Second Day of August, 1994

*Attest:*

*Attesting Officer*

BRUCE LEHMAN

*Commissioner of Patents and Trademarks*